United States Patent [19]

Terlecke

[11] 4,425,956

[45] Jan. 17, 1984

[54] VERTICAL BLIND MECHANISM

[75] Inventor: Mark J. Terlecke, Madison, Wis.

[73] Assignee: Graber Industries, Inc., Middleton, Wis.

[21] Appl. No.: 380,033

[22] Filed: May 20, 1982

[51] Int. Cl.[3] ..... E06B 9/30

[52] U.S. Cl. ..... 160/168 R

[58] Field of Search ..... 160/166–178, 160/345

[56] References Cited

U.S. PATENT DOCUMENTS

| | | | |
|---|---|---|---|
| 3,199,142 | 8/1965 | Salzmann et al. | 160/345 |
| 3,996,988 | 12/1976 | de Wit | 160/176 R |
| 4,114,673 | 9/1978 | de Wit et al. | 160/168 R |
| 4,122,884 | 10/1978 | Salzmann | 160/168 R |
| 4,350,197 | 9/1982 | Haller | 160/166 A |

*Primary Examiner*—Peter M. Caun

*Attorney, Agent, or Firm*—Vernon J. Pillote

[57] ABSTRACT

A venetian blind mechanism having a lead and a plurality of auxiliary carriers supported for traversing movement along a header between a retracted and an extended position and vane supports mounted on the auxiliary carriers for turning about an upright axis for light control. An operating chain is connected intermediate its ends to the lead carrier and has first and second chain portions extending lengthwise of the header in meshing engagement with sprockets on the auxiliary carriers to control spacing between the auxiliary carriers. Chain operating means is associated with the ends of the first and second chain portions for moving them in relatively opposite directions to effect rotation of the vane supports. A chain locking device is provided for automatically locking the chain to the sprocket on an auxiliary carrier when the carriers are retracted, to restrain movement of the operating chain by the chain operating means.

8 Claims, 12 Drawing Figures

VERTICAL BLIND MECHANISM

CROSS-REFERENCE TO RELATED APPLICATION

This application is related to the copending application of Edward M. Kaucic for "Vertical Blind Mechanism" filed May 17, 1982, Ser. No. 1,378,759 and assigned to the assignee of the present application.

BACKGROUND OF THE INVENTION

In the aforementioned application of Edward M. Kaucic, there is disclosed and claimed a vertical blind mechanism comprising a rod having lengthwise extending track means and a lead carrier and a plurality of auxiliary carriers are mounted on the track means for movement along the rod. A vane support is mounted on each auxiliary carrier for turning about an upright axis and a sprocket is mounted for axial rotation on each vane carrier and connected through drive means to the associated vane support for turning the latter. A chain return means is provided on the lead carrier and a flexible chain is looped intermediate its ends around the chain return means and has first and second chain portions extending from the chain return means lengthwise of the rod toward one end of the latter. First and second chain guide means are provided on each auxiliary carrier for retaining the first and second chain portions in meshing engagement with the associated sprocket at diametrically opposite sides thereof. A traverse means is connected to the lead carrier for moving the lead carrier along the rod between a retracted position adjacent said one end of the rod and an extended position spaced along the rod from said retracted position and means are provided for releasably retaining the lead carrier in its extended position on the rod with the first and second chain portions drawn lengthwise of the rod. The first and second chain portions limit maximum separation between the carriers when the lead carrier is moved in one direction along the rod away from said one end to said extended position, and chain operation means associated with the ends of said first and second chain portions is operable to relatively move said first and second chain portions lengthwise in relatively opposite directions for rotating the sprockets to turn the vanes when the lead carrier is in its extended position.

When the carriers are in a partial or fully retracted condition on the rod, the first and second portions of the chain form loops between adjacent carriers. If the chain operating means is operated to move the chain portions in relatively opposite directions for rotating the slats when the carriers are in a partially or fully retracted condition, the slack loops in the chain portions sometimes become entangled or looped around other parts.

SUMMARY OF THE INVENTION

It is the object of this invention to overcome the above problem by providing the aforedescribed vertical blind mechanism with a chain locking device which is automatically operative to lock the chains to the sprocket on an auxiliary carrier in a manner to restrain movement of the chain portions by the chain operating means, when the carriers are retracted to open the blind.

Accordingly, the present invention provides, in a vertical blind mechanism comprising, a rod having lengthwise extending track means, a lead carrier and a plurality of auxiliary carriers mounted on the track means for movement along the rod, a vane support mounted on each auxiliary carrier for turning about an upright axis, a sprocket means mounted for axial rotation on each vane carrier and drive means connecting each sprocket means to the associated vane support for turning the latter, chain return means on said lead carrier, a flexible chain looped intermediate its ends around the chain return means and having first and second chain portions extending from the chain return means lengthwise of the rod toward one end of the latter, first and second chain guide means on each auxiliary carrier for respectively retaining the first and second chain portions in meshing engagement with the associated sprocket at diametrically opposite sides thereof, traverse means connected to the lead carrier operable to move the lead carrier along the rod between a retracted position adjacent said one end of the rod and an extended position spaced along the rod from said retracted position, means for releasably retaining the lead carrier in its extended position with the first and second chain portions drawn lengthwise of the rod, the first and second chain portions limiting maximum separation between the carriers when the lead carrier is moved in one direction along the rod away from said one end to said extended position, and chain operation means associated with the ends of said first and second chain portions operable to relatively move said first and second chain portions lengthwise in relatively opposite directions for rotating the sprockets to turn the vanes, the improvement comprising a chain locking device inside the rod at a location in the path of movement of the sprocket on one of the auxiliary carriers when it is retracted toward one end of the rod, the chain locking device having chain guide passage means therein for guidably engaging the first and second chain portions for movement in relatively opposite directions therethrough, the chain guide passage means maintaining the first and second chain portions passing therethrough spaced apart a distance substantially less than the pitch diameter of the sprocket on said one auxiliary carrier to lock the first and second chain portions to the sprocket on that carrier when said one auxiliary carrier is retracted into engagement with said chain locking device.

These, together with other objects and advantages of this invention, will be more readily understood by reference to the following detailed description when considered in connection with the accompanying drawings wherein.

The vertical blind mechanism includes a header rod H adapted to be mounted as by brackets (not shown) on a support surface to extend horizontally across a window opening and rod end caps $C_1$ and $C_2$ at opposite ends of the header rod.. A plurality of auxiliary carriers AC are mounted on the rod for traversing movement therealong and a vane support VS is mounted on each auxiliary carrier for turning movement about an upright axis to rotate a vane V supported by each van support. A lead carrier LC is also mounted on the rod for traversing movement therealong and is extended and retracted by means of a traverse cord TC that extends lengthwise of the rod. A flexible operating chain OC is operatively connected to a lead carrier LC and has first and second chain portions $OC_1$ and $OC_2$ extending lengthwise of the rod and engaging van drive sprockets on each of the auxiliary carriers to control spacing between the auxiliary carriers when the lead carriage is extended to close the blind, and to control rotation of the vane supports when the first and second chain sections are moved relative to each other. The traverse cord TC and operating chain OC are operated from adjacent one end of the rod and a latch mechanism LM is provided for releasably latching the lead carrier to the other end of the rod to releasably hold the blind in its closed position.

Figure 8:
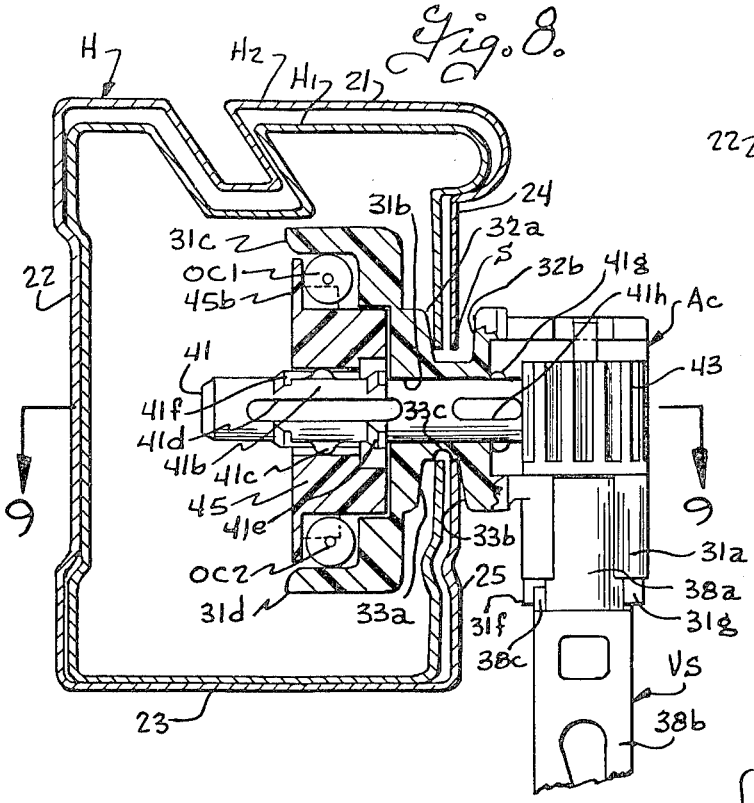
FIG. 8 is a transverse sectional view taken on the plane 8—8 of FIG. 2 and illustrating the parts on a larger scale than FIG. 2.

It is sometimes desirable to be able to adjust the length of the header rod at the time of installation to accomodate windows of different widths and, for this purpose the rod H is advantageously formed in inner and outer telescopically adjustable rod sections $H_1$ and $H_2$. In the preferred embodiment illustrated, the trackway is formed at the rear side of the rod so as to be concealed from view at the front and bottom of the rod. The inner and outer rod sections $H_1$ and $H_2$ have a like configuration except that the inner rod section has a slightly smaller cross-section than the outer rod section to be telescopically receivable therein, and like numerals are used to designate corresponding parts of the inner and outer rod sections. More specifically, the outer and inner rod sections each include a top wall 21, a front wall 22, a bottom wall 23, and upper and lower rear wall portions 24 and 25 that are spaced apart to define a slot S. The auxiliary carriers AC each include a slide body 31 that extends through the slot S in the rod sections. The slide bodies are formed of a resilient wear resistant material and may, for example, be formed of synthetic resin such as acetal resin. As best shown in FIG. 8, each slide body has an upper groove with laterally spaced inner and outer upper guide walls **32*a*, 32*b* and a lower groove with laterally spaced inner and outer lower guide walls 33*a* and 33*b* arranged to guide the auxiliary carrier along the upper and lower rear rod wall portions 24 and 25. A vane support VS is rotatably supported on each of the slide bodies 31 rearwardly of the header rod for rotation about an upright axis and has a shaft portion 38*a* and a lower vane engaging portion 38*b*. The vane supports VS are of a synthetic resin material which is preferably transparent and may, for example, be formed of a transparent polycarbonate resin. In order to facilitate assembly and also disassembly for replacement of the vane supports, the slide bodies 31 are formed with a semi-cylindrical sleeve portion 31*a* that extends through slightly greater than 180° and adapted to rotatably receive the generally upright shaft portion 38*a*** of a vane support with a snap fit.

Figure 9:
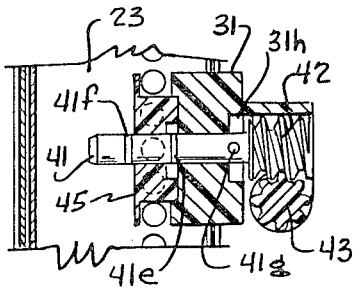
FIG. 9 is a fragmentary horizontal sectional view taken on the plane 9—9 of FIG. 8.
Figure 10:
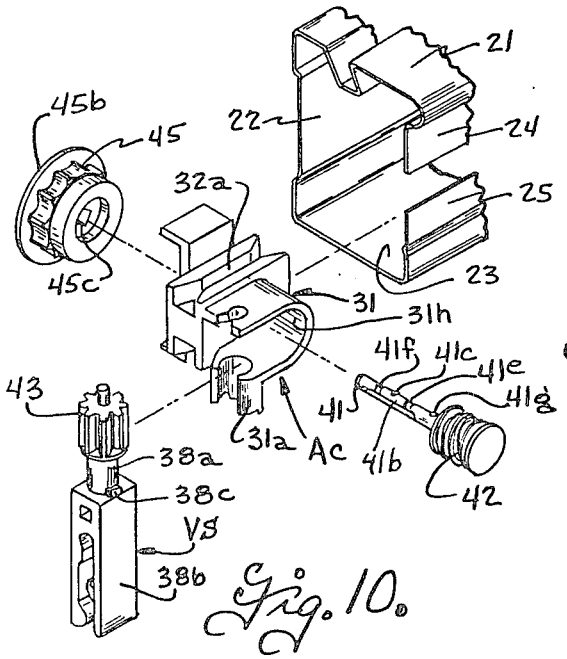
FIG. 10 is an exploded perspective view of one of the vane carriers.

A drive shaft 41 is mounted in a bore **31*b* in each slide body for rotation about a generally horizontal axis transverse to the rear wall of the rod and a right angle gear drive connects the outer end portion of the drive shaft to the vane support. The drive shaft is conveniently formed of a synthetic resin material which may, for example be an acetal resin. As best shown in FIGS. 8 and 9, the right angle drive shaft includes a worm gear 42 formed integrally with the outer end of the drive shaft 41 and which meshes with a worm wheel 43 conveniently formed integrally with the upper end of the shaft 38*a* on the vane support. The gear drive is advantageously arranged to effect a speed reduction between shaft 41 and vane support VS to enable more accurate control of the angular position of the vane support and to also reduce the tension on the operating chain OC required to rotate the vane supports on all of the auxiliary carriers. For example, the worm and worm wheel drive shown provides about an eight to one speed reduction, so that four revolutions of the shaft 41 turn the vane support through 180°. A sprocket 45 is provided on the inner end of the drive shaft on each auxiliary carrier for rotating the drive shaft and chain retainer guides 31*c* and 31*d* are provided on the slide body to guidably retain the first and second runs $OC_1$ and $OC_2$ of the operating chain in meshing engagement with the associated sprocket at diametrically opposite sides of the sprocket. The sprocket has a flange 45*b* at one side and the chain retainer guides 31*c* and 31*d* have a portion extending along the side of the sprocket opposite the flange 45*b* and a portion spaced outwardly from the periphery of the sprocket at diametrically opposite sides thereof for retaining the bead chain in meshing engagement with the sprocket. A slip clutch is advantageously provided in the drive between the sprocket and the vane support to prevent damage to parts in the event one or more of the vanes engages an obstruction during rotation and to also enable synchronization of the vanes on the several auxiliary carriers. The slip clutch is provided between the sprocket 45 and the drive shaft 41 and, as best shown in FIG. 10, the sprocket is provided with a non-circular opening 45*c*, conveniently square in cross-section, and the drive shaft 41 is provided with a radially compressible portion 41*b* that extends into the hole opening 45*c* in the sprocket and which has a protrusion 41*c* engageable with the non-circular opening 45*c* in the sprocket. The shaft 41 is formed of a resilient plastic material and the radially compressible portion 41*b* is provided by a diametrical slot 41*d* in the shaft. The protuberance 41*c* is provided on the outer periphery of the shaft at a location intermediate the ends of the slot and normally extends into a corner of the non-circular opening 45*c* so that the shaft normally rotates with the sprocket, but can yield in the event rotation of the shaft is restricted. Locating lugs 41*e* and 41*f* are also provided on the outer periphery shaft in the diametrically compressible portion of the shaft and, as best shown in FIG. 8, one end of each of the lugs is beveled or inclined to facilitate insertion of the shaft through the bore 31***b* in the slide and through the opening 45*c* in the sprocket. The lug 41*e* is provided at a location on the shaft to engage the inner side of the slide body 31 to inhibit axial withdrawal of the shaft, and the lug 41*f* is provided at a location to engage the inner side of the sprocket to axially retain the sprocket on the shaft. With this arrangement, the shaft can be pressed through the bore 31*b* in the slide body 31 and through the non-circular opening 45*c* in the sprocket to assemble the drive gear worm and sprocket on the slide body. A lug 38*c* is provided on the shaft portion 38*a* of the vane support VS and arranged to engage stops 31*f* and 31*g* on the sleeve 31*a* to limit angular movement of the vane support. These stops are angularly spaced apart with relation to the lug 38*c* so that the vane can rotate through slightly greater 180° to assure full closing of the vanes in either of two oppositely rotated positions.

The chain retainer guides 31*c* and 31*d* on each carrier normally maintain the first and second portions of the chains in meshing engagement with the respective sprockets at diametrically opposite sides and maintain a preset spacing of the auxiliary carriers along the chains. There are some occasions, for example when adjusting the length of the rod, that it is desirable to adjust the spacing between one or more auxiliary carriers. For this purpose, provision is made for disengaging the sprocket on one or more of the auxiliary carriers from the bead chains to allow adjustment of the spacing between the auxiliary carriers after the rod is assembled. As best shown in FIGS. 8 and 9, the slide body is formed with a bore 31*h* arranged to permit limited axial movement of the shaft 41 and worm 42 in a direction inwardly of the rod, that is to the left as viewed in FIGS. 8 and 9. A means is provided to releasably retain the shaft in the position shown in FIGS. 8 and 9, in which the sprocket is in meshing engagement with the chain. In the preferred embodiment shown, rounded protuberances 41*g* are provided on the shaft 41 at a location to engage the inner end of the bore 31*h* and normally maintain the shaft and sprocket to the position shown in FIGS. 8 and 9. The shaft 41 is formed with a diametrically extending slot 41*h* so as to be radially compressible in the region adjacent the protuberances 41*g*. With this arrangement, the shaft can be pressed axially inwardly from the position shown in FIGS. 8 and 9 to disengage a sprocket from the bead chain, for example by either pressing on the outer end of the worm gear or by manually turning the vane carrier in a counterclockwise direction as viewed in FIG. 9. Thus, the sprocket can be shifted axially inwardly relative to the chain retainer guides 31*c* and 31*d* to allow the bead chain to disengage from the sprocket so that the auxiliary carrier can be manually moved axially along the rod until the desired spacing relative to an adjacent auxiliary carrier is achieved. The sprocket is thereafter moved axially outwardly, as by applying torque on the vane support in a clockwise direction as viewed in FIG. 9, to re-engage the sprocket with the portions $OC_1$ and $OC_2$ of the bead chain.

In the adjustable rod using telescoping rod sections, the slide bodies must not only be adapted for sliding on the inner rod section or the outer rod section, but also where the two rod sections overlap as shown in FIG. 8. The guide walls 32*a*, 32*b* and 33*a*, 33*b* diverge outwardly from their bases at a shallow angle of the order of 5° and, in order to allow free movement of the slide bodies along the overlapping portions of the inner and outer rods, the spacing between the guide walls 32*a*, 32*b* and 33*a*, 33*b* is made substantially greater than the combined thickness of the upper and rear wall portions of the rod along opposite sides of the slot. In order to maintain the axis of the vane supports substantially vertical when the slides are in the overlapping portions of the rod sections $H_1$ and $H_2$, the upper inner guide wall 32*a* that engages the inside of the upper rear wall portion 24 is offset from the lower outer guide wall 33*b* that engages the outside of the lower rear wall portion 25 a distance slightly greater than twice the combined thickness of the overlapping rear wall portion of the rod. In order to maintain the vane support axis generally upright when the slides are supported on a single rod section such as an inner rod section $H_1$ or the outer rod section $H_2$, a lengthwise extending recess 33*c* (FIG. 8) is provided in the base of the lower groove in the slide body. The recess 33*c* has a width less than the combined thickness of overlapping lower rear wall portions of rod sections $H_1$ and $H_2$ to receive and ride on the upper edge of only a single rear wall portion. The lower recess is located laterally on the slide in relation to the upper guide edge 32*a* that engages the inner side of the upper rod wall portion to support the slide body on a single rod section $H_1$ or $H_2$ with the vane axis substantially vertical. Since the transverse width of the groove 33*c* is less than the combined thickness of the lower rear wall portions of the overlapping rod sections, the lower rear wall portions of the overlapping rod sections do not extend into the recess but instead ride on the base of the lower guide groove.

The master carrier LC comprises a slide body 55 having upper and lower grooves 55*a* and 55*b* for receiving the upper and lower rear wall portions 24 and 25 of the rod sections, to guide the lead carrier for movement along the rod. The lead carrier is moved along the rod by the traverse cord TC and the end caps $C_1$ and $C_2$ are constructed and arranged to provide cord guides for the traverse cord. The end caps $C_1$ and $C_2$ are of like construction, except that the end cap $C_1$ is dimensioned for reception in the end of the inner rod section $H_1$ and the end cap $C_2$ is dimensioned for reception in the end of the outer rod section $H_2$, and like numerals are used to designate corresponding parts of the end caps $C_1$ and $C_2$. The end caps are conveniently molded in one piece of a synthetic resin material and each include an end wall 61 adapted to overlie the end of the respective rod section and rear wall portions 62*a* and 62*b* adapted to overlie the inside of the rear wall portions 24, 25 at the respective rod section. The rear wall portions 62*a* and 62*b* are spaced apart to define a notch 62*c* therebetween having a width corresponding to the width of the slot S in the rod sections and adapted to be aligned therewith to allow a carrier such as the lead carrier LC to slide from the rod section into the notch 62*c*, to positively locate the lead carrier in the end cap. In order to accurately locate the upper and lower rear wall portions 24 and 25 of the rod section relative to the rear wall portion 62*a* and 62*b* of the end cap, the rear wall portions 24 and 25 of the rod sections are formed with notches 24*a* and 25*a* respectively (FIG. 1) that open at one end of the rear wall portions and the wall portions 62*a* and 62*b* of the end caps are formed with generally T-shaped ribs 62*d* and 62*e* that are adapted to extend into the notches 24*a* and 25*a* to control the vertical spacing of the rear wall portion, and to overlie the rear sides of the rear wall portions of the rod adjacent the notches to laterally position the rear wall portions of the rod relative to the rear wall portions of the end cap. A latch 64 is formed on the end of a resilient arm integral with the end wall of the end cap and arranged to project into an opening 21*a* in the top wall of the respective rod section, to lock the end cap to the respective rod section.

Figure 2:
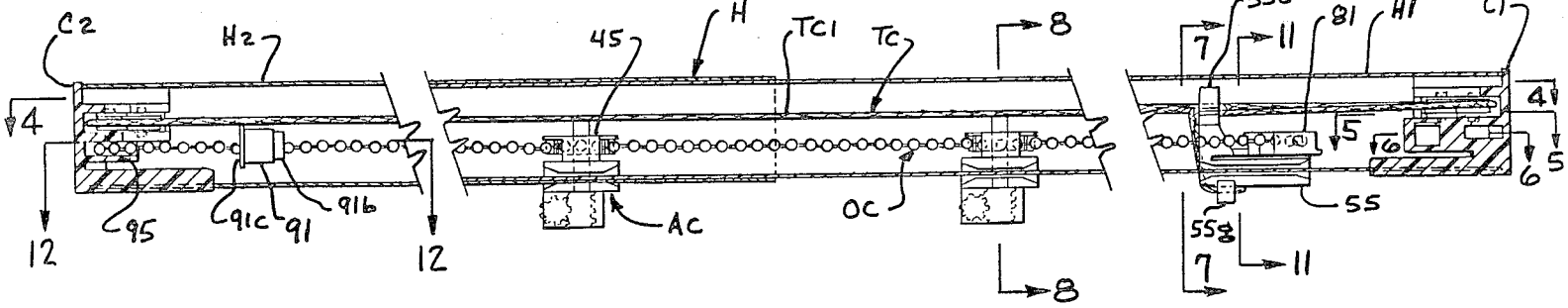
FIG. 2 is a horizontal sectional view through the vertical blind mechanism, with the traverse and operating cords arranged for right-hand operation (as viewed from the front of the rod)
Figure 4:
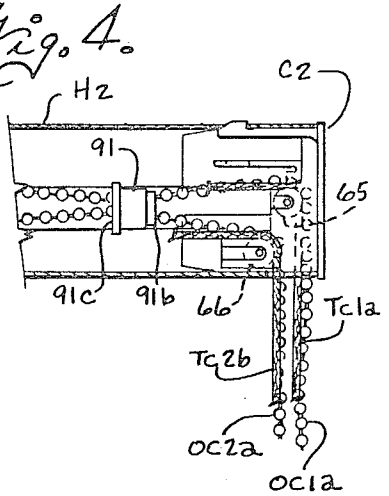
FIG. 4 is a longitudinal sectional view taken on the plane 4—4 of FIG. 2.

The traverse cord guides on the end caps $C_1$ and $C_2$ are best shown in FIGS. 2 and 4 and comprise a pair of rollers 65 and 66 supported for rotation about axes that are vertically and horizontally offset to enable the traverse to be arranged for either right-hand or left-hand draw. The traverse cord TC has one end portion $TC_1$ connected to the lead carrier LC and arranged to extend therefrom lengthwise of the rod and over the cord guide pulley 65 on the end cap on one end of the rod, and then downwardly to provide a first traverse cord operating portion $TC_{1a}$. The traverse cord also has a second portion $TC_2$ which is also connected to the lead carrier and which extends from the lead carrier lengthwise of the rod over a cord guide pulley 65 at the other end of the rod then in a return run $TC_{2a}$ lengthwise of the rod and over a cord guide pulley 66 at the first mentioned head of the rod and downwardly to provide a second traverse cord operating portion $TC_{2b}$. The operation portions $TC_{1a}$ and $TC_{2b}$ of the traverse cord are tensioned as by cord guides and, as will be seen, pulling on one of the traverse cord operating portions $TC_{1a}$ will move the lead carrier LC in one direction along the rod to an open position, and pulling on the other traverse cord operating portion $TC_{2b}$ will move the lead carrier in the opposite direction along the rod to a closed position.

Figure 3:
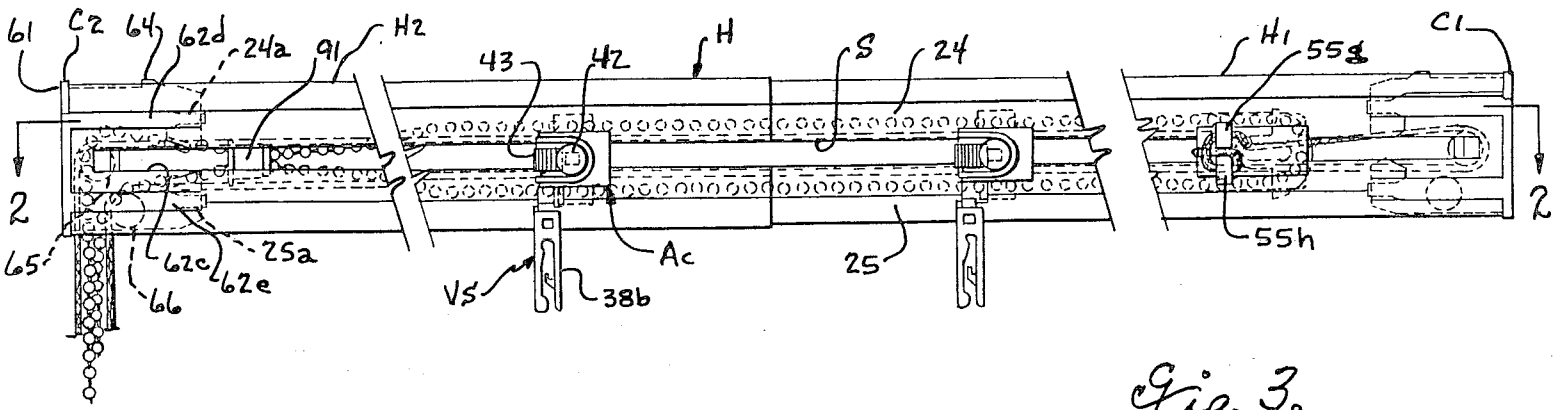
FIG. 3 is a rear elevational view of the vertical blind mechanism of FIG. 2.
Figure 7:
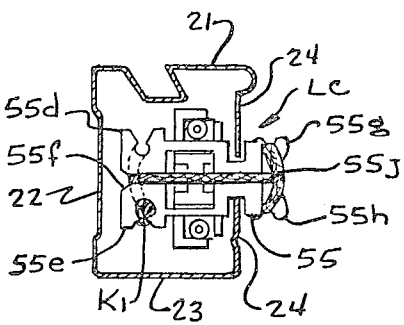
FIG. 7 is a transverse sectional view taken on the plane 7—7 of the FIG. 2.

An improved cord lock arrangement is provided for adjustably securing one end of the traverse cord to the lead carrier to facilitate adjustment of the length of the traverse cord with adjustments in the length of the header. As best shown in FIGS. 2, 3 and 7, the lead carrier has upper and lower inner cord retainers 55*d* and 55*e* on the slide body 55 inside the rod which define a notch 55*f* therebetween, and a second pair of upper and lower cord retainers 55*g* and 55*h* on the slide body outside the rod which define a notch 55*j* therebetween. The inner and outer upper cord retainers 55*d* and 55*g* have upwardly opening generally keyhole shaped notches, and the inner and outer lower cord retainers 55*e* and 55*h* have downwardly opening generally keyhole shaped notches. As will be seen from FIG. 7, the keyhole shaped notches have a generally circular base portion dimensioned to snugly receive the traverse cord and a V-shaped outer portion that intersects the circular base portion on a constricted area to allow the traverse cords to be pressed laterally into the notches and retained therein. The end of one of the traverse cord portions $TC_1$ is connected to the inner retainers and as best shown in FIG. 7, is snapped into the notch in the upper inner cord retainer 55*d* and then passed downwardly and snapped into the notch on the lower inner cord retainer 55*e*, with a knot $K_1$ provided at the end of the traverse cord portion $TC_1$. The end of the other traverse cord portion $TC_2$ is passed through the notch 55*f* between the upper and lower inner cord retainers and laterally outwardly across one end of the slide body 55 and through the notch 55*j* between the outer cord retainers, and is then looped around the upper and lower outer cord retainers 55*g* and 55*h* as shown in FIG. 3 and pressed into the notches therein. As will be seen from FIG. 3, the portion of the end of the traverse cord that passes between the upper and lower outer cord retainers crosses the portion of the traverse cord that passes through the notch 55*j*, to aid in retaining the traverse cord against detachment from the lead carrier. With this arrangement, the length of the traverse cord can be readily adjusted by merely pulling the end of the traverse cord $TC_2$ out of the outer cord retainers 55*g* and 55*h* and then pulling outwardly on the traverse cord until it is adjusted to the desired length, after which the end is again looped around the upper and lower outer cord retainers and pressed into the notches therein.

Figure 6:
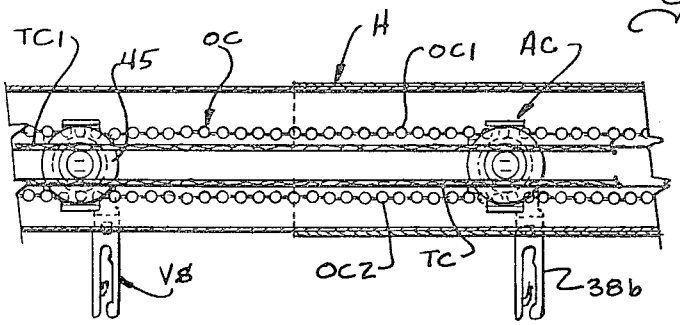
FIG. 6 is a fragmentary longitudinal sectional view taken on the plane 6—6 of FIG. 2 and illustrating parts of the lead carrier in still another moved position and on a larger scale than FIG. 2.
Figure 6:
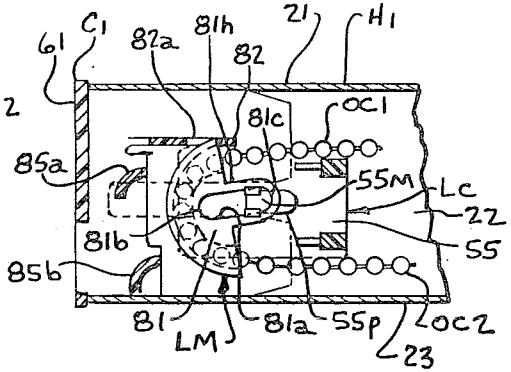
Figure 5:
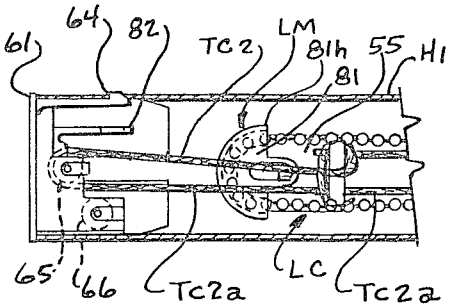
FIG. 5 is a fragmentary longitudinal sectional view taken on the plane 5—5 of FIG. 2 and showing parts of the lead carrier in a moved position and on a larger scale than FIG. 2.
Figure 5:
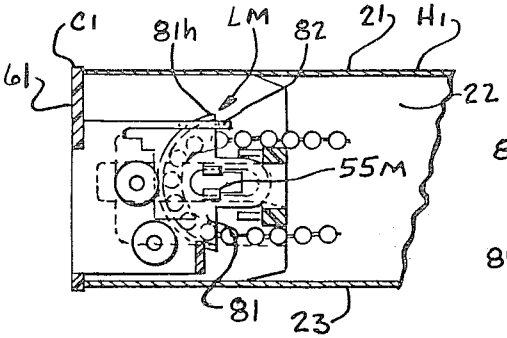
Figure 11:
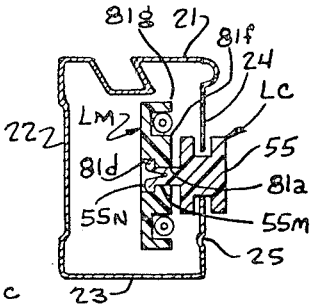
FIG. 11 is a transverse sectional view taken on the plane 11—11 of FIG. 2 and showing the parts on a larger scale than FIG. 2.

The lead carrier LC is also connected to the operating chain OC to draw the auxiliary carriers therewith when the lead carrier is extended to close the blind, and the latch mechanism LM is provided to releasably latch the lead carrier to one of the end caps. The latch mechanism LM comprises a latch member 81 mounted on the lead carrier and a keeper 82 on the end caps. The latch member 81 comprises a latch body that is slidably mounted on the inner side of the lead carrier body 55 for limited movement relative thereto in a direction paralleling the length of the rod. The latch body 81 has an elongated opening extending therethrough defining the laterally spaced side walls 81*a*, first and second end walls 81*b*, 81*c*, as best shown in FIG. 6, and inwardly opening recesses 81*d* (FIG. 11) in the opposite side walls 81*a*. The lead carrier 55 has resilient latch retaining lugs 55*m* extending laterally of the front side of the lead carrier body adapted to be received between the side walls 81*a* of the opening in the latch body, and flanges 55*n* on the outer ends of the lugs adapted to extend into the recesses 81*d* in the latch body as shown in FIG. 11. The lugs 55*m* have a length in a direction parallel to the length of the header which is short as compared to the length of the opening 81*a* so that the latch body can slide relative to the lead carrier body in a direction paralleling the length of the rod between a first position in which the first end 81*b* of the opening engages the lugs 55*m* as shown in FIG. 5 and a second position in which the second end 81*c* of the opening engages the lugs 81*m* as shown in FIG. 6. A guide rib 55*p* (FIG. 6) is also provided on the forward face of the lead carrier body and arranged to guidably engage the side walls 81*a* on the latch body, and the end 81*c* of the latch body is recessed to pass over the rib 55*e* during movement of the latch body from its first position to its second position. The rib 55*p* has a length which is long as compared with the transverse width of the slot and guides the latch body for sliding movement and effectively prevents tilting movement of the latch body relative to the slide body until the latch body reaches its second position. The lugs 55*m* are laterally resilient and, when the body reaches its second position, it can tilt a limited amount relative to the slide body in a direction crosswise of the header, the lugs 55*m* being laterally compressed during such tilting to resiliently urge the latch member back to a position in which the elongated slot is aligned with the rib 55*p*.

Figure 1:
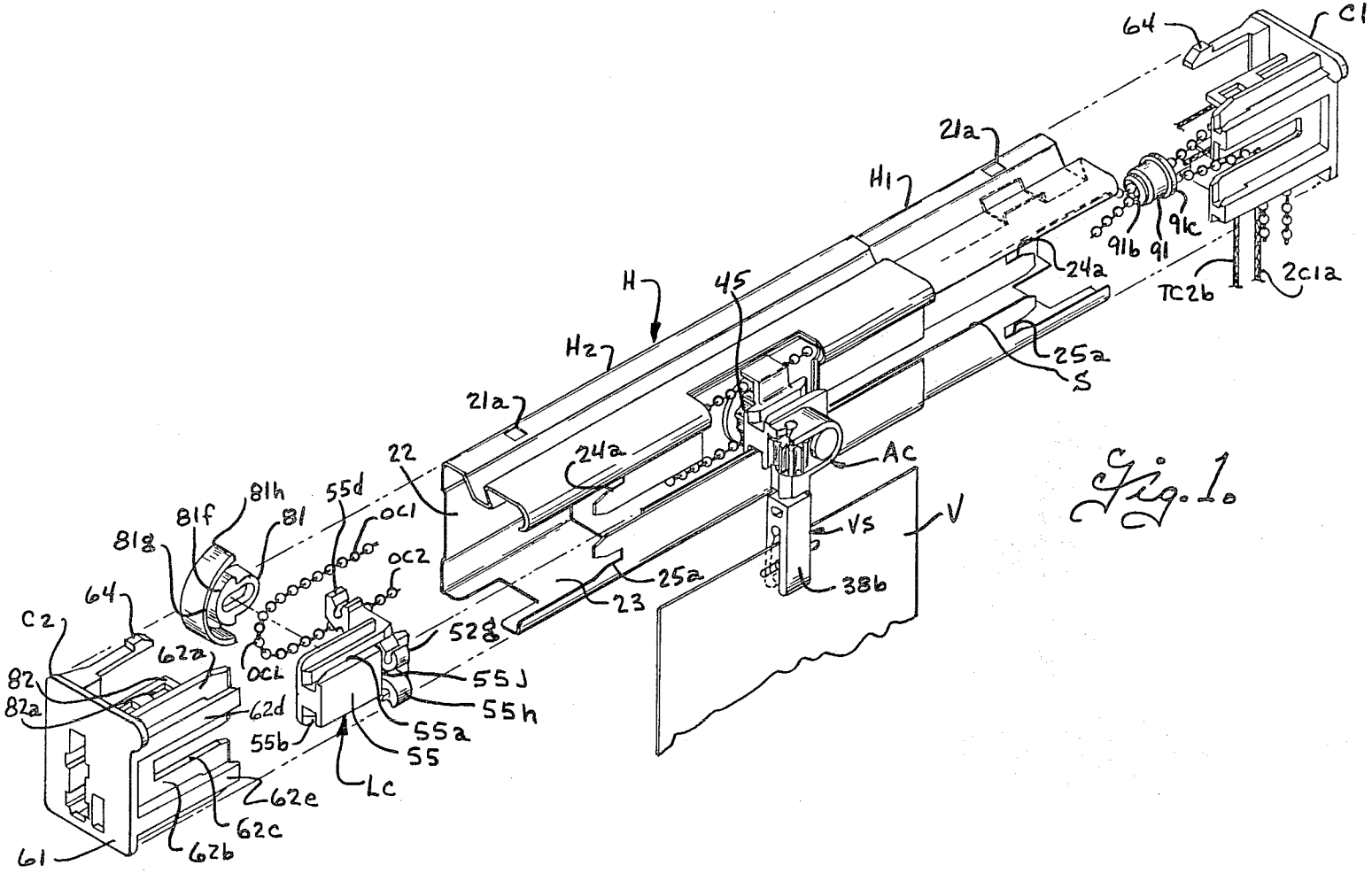
FIG. 1 is a fragmentary exploded perspective view of a vertical blind mechanism, arranged for left-hand operation (as viewed from the front of the rod)

The latch body is connected to the operating chains in a manner such that tension on the operating chain normally urges the latch body to its first position relative to the lead carrier. As best shown in FIG. 1 and 11, the latch body has semi-circular inner and outer wall portions 81*f* and 81*g* that define an arcuate chain guide groove therebetween for receiving an end loop OCL of the operating chain OC. Latch noses 81*h* are formed on the ends of the outer wall portion 81*g* for engagement with the aforementioned keeper 82 on the end cap. The keeper 82 comprises a resilient blade like member having one end formed integrally with the end wall 61 of the end cap. The blade extends generally lengthwise of the rod and has an opening 82*a* adjacent at the free end adapted to receive a latch nose 81*h* on the latch body. The blade portion 82 is positioned in the path of travel of the nose portion 81*h* on the latch body and, when the lead carrier moves into the notch 62*c* on the end cap, the latch member is in its first position on the lead carrier and the arcuate lead face on the outer wall 81*g* of the latch member cams the keeper member upwardly until it passes over the nose portion 81*h*. The tension on the operating chain normally urges the latch body to its first position on the lead carrier and the keeper 82 normally operates to retain the lead carrier in its extended position. However, when the lead carrier is retracted by the traverse cords, the lead carrier moves relative to the latch member until the latch member reaches its second position. At that time, latch member can tilt relative to the lead carrier as shown in FIG. 6 and release engagement with the keeper.

Figure 12:
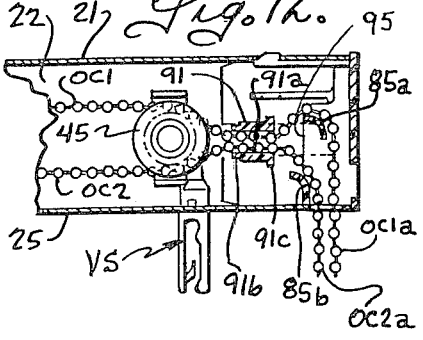
FIG. 12 is a fragmentary vertical sectional view taken on the plane 12—12 of FIG. 2 and illustrating parts in a moved position and on a larger scale than FIG. 2.

The operating chain has portions $OC_1$ and $OC_2$ that extend from the looped end OCL lengthwise of the header to the other end thereof, and provision is made for moving the chain portions $OC_1$ and $OC_2$ longitudinally relative to each other to effect rotation of the vane supports. As best shown in FIG. 12, the chain portions $OC_1$ and $OC_2$ extend over chain guides 85*a* and 85*b* on the end cap to downwardly extending operating portions $OC_{1a}$ and $OC_{2a}$ respectively. The chain guides 85*a* and 85*b* are vertically and horizontally offset from each other to vertically separate the chain portions $OC_1$ and $OC_2$ and to horizontally separate the chain portions $OC_{1a}$ and $OC_{2a}$. The operating portions $OC_{1a}$ and $OC_{2a}$ are conveniently connected in a loop by a bead chain connect to prevent pulling of one end of the operating chain out of the rod. As previously described, the auxiliary carriers are connected to the chain portions $OC_1$ and $OC_2$ at spaced locations therealong corresponding to the desired spacing between the centers of adjacent vane and, when the lead carrier LC is moved from an open position adjacent one end of the rod to a closed position adjacent the opposite end of the rod, it draws the looped end OCL of the bead chain therewith and pulls the auxiliary carriers along the rod while controlling the maximum spacing between adjacent auxiliary carriers. When the lead carrier is latched to the end cap in the closed position of the blind, pulling on one or the other operating portions $OC_{1a}$ or $OC_{2a}$ of the chain will move the chain portions $OC_1$ and $OC_2$ in relatively opposite directions and rotate the vane supports accordingly.

When the blind is in an open condition, the operating portions $OC_1$ and $OC_2$ of the bead chain form loops between adjacent carriers. If the operating portions of the bead chain $OC_{1a}$ or $OC_{2a}$ are pulled when the blind is in a partially or fully opened condition, the slack loops in the chain portions $OC_1$ and $OC_2$ sometimes become entangled or looped around other parts.

The inventions heretofore described were disclosed to me and are not my invention. In accordance with my invention the aforesaid vertical blind mechanism is provided with a chain locking device 91 which is automatically operative to lock the chain portions $OC_1$ and $OC_2$ to the sprocket on an auxiliary carrier in a manner to effectively prevent movement of the chain by the chain operating means, when the carriers are retracted to open the blind. The locking device 91 comprises a body having chain guide passage means 91*a* therein for guidably engaging the first and second chain portions for movement in relatively opposite directions. In the embodiment illustrated, the locking device is in the form of a sleeve having ends 91*b* and 91*c* and a single guide passage for both the first and second chain portions, with the internal opening in the sleeve sufficiently greater than twice the cross-section of the bead chain to allow the chain portions $OC_1$ and $OC_2$ to pass in relatively opposite directions therethrough. The sleeve can have a circular cross-section as shown or an oblate cross-section if desired. It is also contemplated, that separate guide passages could be provided in the device 91 for the chain portions $OC_1$ and $OC_2$. The chain guide passage means has a length between ends 91*b* and 91*c* somewhat greater than the pitch of the beads along the chain to facilitate guiding of the chain portions longitudinally therethrough. The chain guide passage means is arranged to maintain the first and second chain portions passing therethrough spaced apart a distance substantially less than the pitch diameter of the sprockets on the auxiliary carriers to lock the first and second chain portions to the sprocket on an auxiliary carrier, when that carrier is retracted into engagement with the chain locking device. The chain locking device is preferably arranged to engage the chain portions $OC_1$ and $OC_2$ at a location intermediate one end cap and the sprocket on the adjacent end auxiliary carrier. However, it is contemplated that the chain locking device could also be arranged to engage the chain portions $OC_1$ and $OC_2$ at other locations intermediate adjacent ones of the auxiliary carriers. The locking device is conveniently arranged so that it is supported solely by the chain portions $OC_1$ and $OC_2$. However, it is also contemplated that the locking device could be supported on the rod or end cap, provided it guides the chain portions $OC_1$ and $OC_2$ in the manner described above. In the preferred embodiment shown, the locking device is in the form of a tubular sleeve located adjacent one end cap and supported on the chain portions $OC_1$ and $OC_2$. When the carriers are retracted, one end 91*b* of the locking device engages the sprocket on the adjacent end carrier in the rod and the other end 91*c* of the locking device engages the shoulder 95 on the end cap. The locking device maintains the chain portions passing therethrough spaced apart a distance less than the pitch diameter of the sprocket on the end auxiliary carrier and draws the chain portions $OC_1$ and $OC_2$ part way around the periphery of the sprocket on the end auxiliary carriers when it is retracted. Thus, when the end carrier is retracted to a position in which the end 91*b* of the locking device is adjacent the periphery of the sprocket on the end carrier, the chain portions $OC_1$ and $OC_2$ diverge relative to each other and extend at an angle across the end 91*b* of the locking device. If one or the other of the operation portions $OC_{1a}$ or $OC_{2a}$ of the chain is pulled while the end carrier is retracted, the end 91*b* of the locking device engages the relatively diverging portions of the chains as they pass around the sprocket on the end auxiliary carrier and operates to lock the chain against movement and the sprocket against rotation. As will be seen from FIG. 12, the face at the end 91*b* of the chain locking device forms a sharp included angle of preferably no more than 90° with the chain guide passage 91*a*, so that the interior corner at the end 91*b* of the locking device is adapted to project into the space between adjacent beads when the chain portions extend transverse to the end 91*b*, as occurs when a sprocket is closely adjacent the end 91*b*. The locking device 91 is normally supported by the chain portions $OC_1$ and $OC_2$ at a level intermediate the top and bottom of the sprocket on the end carrier, as shown in FIG. 12, but can float or shift in a direction crosswise of the rod. When the chain portion $OC_{1a}$ is pulled, the upper chain portion $OC_1$ is tensioned and the locking device 91 will tend to shift upwardly toward the top of the sprocket. Conversely, when the chain portion $OC_{2a}$ is pulled, the lower chain portion $OC_2$ is tensioned and the locking device will tend to shift downwardly toward the bottom of the sprocket. However, even when the locking device is shifted upwardly or downwardly in the rod, at least one of the chain portions $OC_1$ or $OC_2$ will extend at a sharp angle crosswise of the end 91*b* and be locked against movement. Further, when either one of the chain portions $OC_{1a}$ or $OC_{2a}$ is pulled, it draws the sprocket on the end carrier more firmly against the locking device 91 to increase the locking effect.

The chain locking device not only operates to lock the chain portions $OC_1$ and $OC_2$ when the auxiliary carriers are fully retracted, but it also provides a chain locking function when the lead carrier is not locked in its extended position. If the lead carrier is not locked in its extended position, a pull on one or the other of the chain operating portions $OC_{1a}$ or $OC_{2a}$ will tend to retract the auxiliary carriers and the chain locking device until the end auxiliary carrier engages the end 91*b* of the locking device and the end 91*c* of the locking device engages the shoulder 95 on the end cap. At that time the locking device will function in the manner previously described. However, when the lead carrier is locked in its extended position on the rod, the end auxiliary carrier is pulled away from the locking device and the chain portions can then pass relatively freely through the chain guide passages in the locking device.

From the foregoing it is through that the construction and operation of the vertical blind mechanism with the chain locking device will be readily understood. The blind mechanism can be opened and closed by operating the traverse cords TC which moves the lead carrier along the rod between an open position adjacent one end of the rod to a closed position adjacent the other end of the rod. The latch mechanism LM on the lead carrier engages a keeper on the end housing to releasably latch the lead carrier in a closed position. When the lead carrier is moved along the rod to a closed position, the looped end OCL of the operating chain is drawn with the lead carrier and this pulls the auxiliary carriers along the rod and controls the spacing between adjacent ones of the auxiliary carriers. When the blind is in its closed condition with the lead carrier latched to the end cap on one end of the rod, the operating portions $OC_{1a}$ and $OC_{2a}$ of the operating chain can be drawn to move the chain portions $OC_1$ and $OC_2$ longitudinally in relatively opposite directions to drive the sprockets and rotate the vane supports. The slip clutch between the sprocket and the drive shaft in conjunction with the rotation stops on the vane supports, enables rotation of all of the vane supports on the rod to be synchronized by pulling the operating chain in one direction until all of the vane supports engage the rotation stop. The speed reducing drive between the sprocket and vane supports provides a very accurate angular adjustment of the vane supports and further reduces the force required to pull the operating chain.

Opening of the blind is effected by pulling on the draw cord in a direction to move the lead carrier away from the end of the rod. The latch member remains in engagement with the keeper 82 until the lead carrier moves relative to the latch member to its second position relative to the lead carrier at which time the latch member can tilt relative to the lead carrier and disengage the keeper. Continued movement of the lead carrier along the rod causes the lead carrier to push the auxiliary carriers together and toward the other end of the rod to an open position.

The chain locking device maintains the chain portions passing therethrough spaced apart a distance substantially less than the pitch diameter of the sprockets on the auxiliary carriers and, when the carriers are retracted, the chain locking device draws the chain portions $OC_1$ and $OC_2$ part way around the periphery of the sprocket on the end auxiliary carrier so that they extend transverse to the end 91*b* of the chain locking device 91. If one or the other of the operating portions $OC_{1a}$ or $OC_{2a}$ of the chain is pulled when the carriers are retracted, the locking device automatically operates to lock the chain portions to the end sprocket and lock the end sprocket against rotation. In this manner, one end of both of the chain portions $OC_1$ and $OC_2$ are locked against lengthwise movement.

The embodiments of the invention in which an exclusive property or privilege is claimed are defined as follows:

1. In a vertical blind mechanism comprising, a rod having lengthwise extending track means, a lead carrier and a plurality of auxiliary carriers mounted on the track means for movement along the rod, a vane support mounted on each auxiliary carrier for turning about an upright axis, a sprocket means mounted for axial rotation on each vane carrier and drive means connecting each sprocket means to the associated vane support for turning the latter, chain return means on said lead carrier, a flexible chain looped intermediate its ends around the chain return means and having first and second chain portions extending from the chain return means lengthwise of the rod toward one end of the latter, first and second chain guide means on each auxiliary carrier for respectively retaining the first and second chain portions in meshing engagement with the associated sprocket at diametrically opposite sides thereof, traverse means connected to the lead carrier operable to move the lead carrier along the rod between a retracted position adjacent said one end of the rod and an extended position spaced along the rod from said retracted position, means for releasably retaining the lead carrier in its extended position with the first and second chain portions drawn lengthwise of the rod, the first and second chain portions limiting maximum separation between the carriers when the lead carrier is moved in one direction along the rod away from said one end to said extended position, and chain operation means associated with the ends of said first and second chain portions operable to relatively move said first and second chain portions lengthwise in relatively opposite directions for rotating the sprockets to turn the vanes, the improvement comprising a chain locking device inside the rod at a location in the path of movement of the sprocket on one of the auxiliary carriers when it is retracted toward said one end of the rod, the chain locking device having chain guide passage means therein for guidably engaging the first and second chain portions for movement in relatively opposite directions therethrough, the chain guide passage means maintaining the first and second chain portions passing therethrough spaced apart a distance substantially less than the pitch diameter of the sprocket on said one auxiliary carrier to lock the first and second chain portions to the sprocket on said one auxiliary carrier when it is retracted into engagement with said chain locking device.

2. The combination of claim 1 wherein the chain operating means includes rod chain guides on said one end of the rod engaging the first and second chain portions at said one end of the rod, said chain locking device being located intermediate the rod chain guides and the sprocket on the auxiliary carrier adjacent said one end of the rod.

3. The combination of claim 1 or 2 wherein said chain locking device is supported by said first and second chain portions.

4. The combination of claim 1 or 2 wherein said chain locking device comprises a tubular sleeve having an internal opening of a size greater than the combined cross-sections of the first and second chain portions.

5. The combination of claim 4 wherein said chain is a bead chain and said sleeve has an end wall adjacent the sprocket sufficiently thin to extend into the spaces between adjacent beads when the chain portions extend transverse to said end of the sleeve.

6. The combination of claim 1 or 3 wherein said chain is a bead chain, said chain locking device having portions at the end adjacent the sprocket on the adjacent auxiliary carrier adapted to extend between adjacent beads on the first and second chain portions when they extend transverse to that end of the chain locking device.

7. The combination of claim 1 including an end cap on said one end of the rod and chain guides for guiding the first and second chain portions from the rod to first and second downwardly extending chain operating portions, the chain locking device comprising a sleeve member supported on the first and second chain portions intermediate the end cap and the adjacent end one of the auxiliary carriers, the sleeve member having a first end adapted to engage the sprocket on the end auxiliary carrier and a second end adapted to engage the end cap when the carriers are retracted, the sprocket on the end auxiliary carrier being spaced in a direction lengthwise of the rod from the chain locking device when the carriers are extended.

8. In a vertical blind mechanism comprising, a rod having lengthwise extending track means, a lead carrier and a plurality of auxiliary carriers mounted on the track means for movement along the rod, a vane support mounted on each auxiliary carrier for turning about an upright axis, a sprocket means mounted for axial rotation on each vane carrier and drive means connecting each sprocket means to the associated vane support for turning the latter, chain return means on said lead carrier, a flexible chain looped intermediate its ends around the chain return means and having first and second chain portions extending from the chain return means lengthwise of the rod toward one end of the latter, an end cap on said one end of the rod and first and second chain guides on the end cap for guiding the first and second chain portions from the rod to first and second downwardly extending chain operating portions, first and second chain guide means on each auxiliary carrier for respectively retaining the first and second chain portions in meshing engagement with the associated sprocket at diametrically opposite sides thereof, traverse means connected to the lead carrier operable to move the lead carrier along the rod between a retracted position adjacent said one end of the rod and an extended position spaced along the rod from said retracted position, means for releasably retaining the lead carrier in its extended position with the first and second chain portions drawn lengthwise of the rod, the first and second chain portions limiting maximum separation between the carriers when the lead carrier is moved in one direction along the rod away from said one end to said extended position, said first and second downwardly extending chain operating portions being manipulable to relatively move said first and second chain portions lengthwise in relatively opposite directions for rotating the sprockets to turn the vanes, the improvement comprising, a chain locking device supported on the first and second chain portions at a location intermediate the end cap and the sprocket on the adjacent end one of the auxiliary carriers, the chain locking device having chain guide passage means therein for guideably engaging the first and second chain portions for movement in relatively opposite directions therethrough, the chain locking device having a first end adapted to engage the sprocket on the end auxiliary carrier and a second end adapted to engage the end cap when the end carrier is retracted, the sprocket on the end auxiliary carrier being spaced in a direction lengthwise of the rod from the chain locking device when the carriers are extended.

* * * * *

UNITED STATES PATENT AND TRADEMARK OFFICE

CERTIFICATE OF CORRECTION

PATENT NO. : 4,425,956

DATED : January 17, 1984

INVENTOR(S) : Mark J. Terlecke

It is certified that error appears in the above-identified patent and that said Letters Patent are hereby corrected as shown below:

Claim 3, column 13, line 16, insert -- solely -- after "supported".

Signed and Sealed this

*Tenth* Day of *April 1984*

[SEAL]

*Attest:*

GERALD J. MOSSINGHOFF

*Attesting Officer*

*Commissioner of Patents and Trademarks*